US005080366A

United States Patent [19]

Okumoto et al.

[11] Patent Number: 5,080,366

[45] Date of Patent: Jan. 14, 1992

[54] WOOD-TYPE GOLF CLUB HEAD

[75] Inventors: Takaharu Okumoto, Chigasaki; Toshio Ninomiya, Isehara, both of Japan

[73] Assignee: The Yokohama Rubber Co., Ltd., Tokyo, Japan

[21] Appl. No.: 531,090

[22] Filed: May 31, 1990

[30] Foreign Application Priority Data

Jun. 12, 1989 [JP] Japan ..... 1-67360[U]

[51] Int. Cl.[5] ..... A63B 53/04

[52] U.S. Cl. ..... 273/167 R; 273/167 A; 273/172; 273/173

[58] Field of Search ..... 273/167 R, 167 A, 167 D, 273/167 F, 167 H, 172, 173

[56] References Cited

U.S. PATENT DOCUMENTS 3,002,757 10/1961 Marciniak ..... 273/167 F X
4,778,185 10/1988 Kurokawa ..... 273/167 H

FOREIGN PATENT DOCUMENTS 63-109167 7/1988 Japan .

*Primary Examiner*—William H. Grieb
*Attorney, Agent, or Firm*—Finnegan, Henderson, Farabow, Garrett & Dunner

[57] ABSTRACT

A wood-type golf club head molded from a fiber-reinforced resin having at least one fin equipped with at least one hook fixed by brazing to the inner side surface of the metal sole plate so that the fiber-reinforced resin of the head will flow into and under the hook of the fin during molding to securely bond the club head to the sole plate.

6 Claims, 1 Drawing Sheet

WOOD-TYPE GOLF CLUB HEAD

BACKGROUND OF THE INVENTION

This invention relates to a wood golf club head. More particularly, the present invention relates to a wood golf club head which improves bondability between a club head main body made of a fiber-reinforced resin and a sole plate made of a metal.

A wood golf club head has a structure wherein a sole plate made of a metal is fitted to the bottom surface of a club head main body. If the wood golf club head is molded from a fiber-reinforced resin as a principal material, the sole plate is molded simultaneously and integrally with the club head main body when the latter is molded from the fiber-reinforced resin. Fixing of the sole plate to the club head main body at this time is made by implanting a pin or pins in advance to the inner surface side of the sole plate and burying the pin(s) into the fiber-reinforced resin of the club head main body. However, the pin is likely to bend by the pressures occuring during molding and this can cause a decrease in the strength of the bond between the body and the sole plate.

To solve this problem it has been proposed in Japanese Utility Model Application Kokai Publication No. 63-109167, to use a fin equipped with a hook that is fixed to the inner side surface of the sole plate by welding in place of the pin described above and which is anchored in the fiber-reinforced resin of the main body by the hook. However, the fin invites another problem in that the gap of the hook is reduced by a build-up portion of welding and the anchoring effect brought forth by the inflow of the fiber-reinforced resin is thus reduced.

Generally, a light-weight aluminum alloy is used as the metal for the sole plate for a #1 driver golf club or #2 brassie golf club having a large head size, but a metal having a high specific gravity such as brass is used for fairway wood golf clubs of #3 and so forth having a small head size in order to attain a low center of mass. However, brass has a different color from the aluminum alloy, and when the golf clubs from the driver golf club to the fairway golf clubs are used as a golf club set, their colors become non-uniform and the commercial value drops.

SUMMARY OF THE INVENTION

It is an object of the present invention to provide a wood golf club head made of a fiber-reinforced resin which has improved bondability between the club head's main body and a sole plate.

It is another object of the present invention to provide a wood golf club head which provides uniformity of color when a plurality of wood golf clubs from a driver golf club to fairway golf clubs are used as a golf club set.

In order to accomplish the first object described above, the wood golf club head in accordance with the present invention has a structure wherein at least one fin equipped with at least one hook is fixed by brazing to the inner side surface of a sole plate made of a metal and in which the fiber-reinforced resin of the club head main body is caused to flow into the hook of the fin so as to integrate the sole plate with the club head main body. Preferably, at least two fins are provided and assembled in a cruciform structure so as to cross one another, to obtain even a higher bonding effect.

In order to accomplish the second object, the sole plate is made of nickel silver.

DESCRIPTION OF THE PREFERRED EMBODIMENTS

Figure 1:
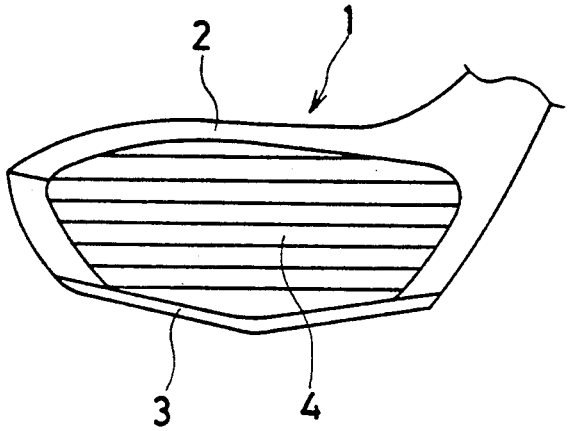
FIG. 1 is a front view of a wood golf club head made in accordance with the present invention.

In the wood golf club head 1 shown in FIG. 1, a club head main body 2 is molded from a fiber-reinforced resin as a principal material and a sole plate 3 made of a metal is integrally fitted to its bottom surface. A face 4 for hitting a ball is formed on the front surface of the club head main body 2.

There is no limitation, in particular, to the fiber constituting the fiber-reinforced resin so long as the fiber exhibits the reinforcing effect, but a carbon fiber, a glass fiber or an aromatic polyamide fiber is preferably used as this fiber. There is no particular limitation, either, to the resin constituting the fiber-reinforced resin, but an unsaturated polyester resin, a vinyl ester resin or an epoxy resin is preferably used from the aspect of strength and machineability.

Figure 2:
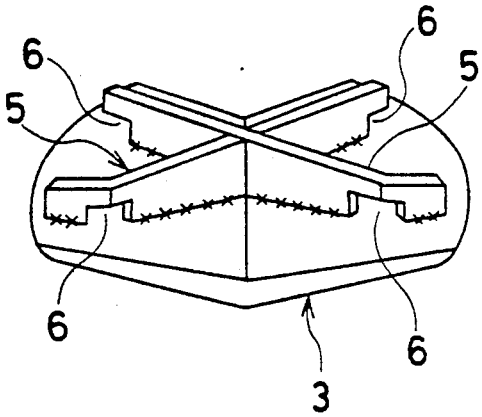
FIG. 2 is a perspective view of a sole plate to be fitted to the wood golf club head of FIG. 1 when viewed from the fin fitting side.
Figure 3:
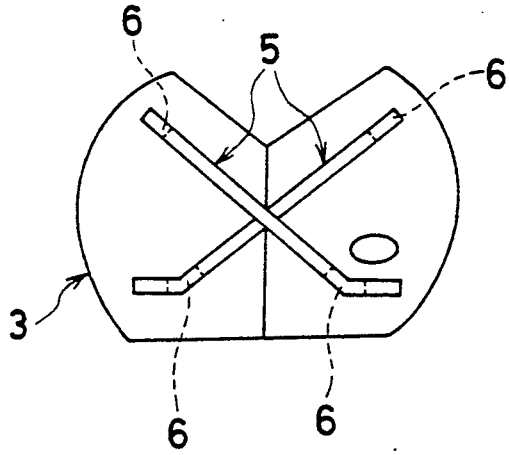
FIG. 3 is a top view of the sole plate of FIG. 2 when viewed from the fin fitting side.

FIGS. 2 and 3 show the sole plate 3 of the invention before it is fitted to club head main body 2. The sole plate 3 in this embodiment has a shape such that it is folded to the right and left at the center but it may be molded in a planar shape as a whole. Two sheet-like fins 5 made of a metal are brazed to the inner surface side of this sole plate 3. Moreover, these two fins 5 have a structure wherein they cross mutually and are assembled in a cruciform shape. The portions represented by an X in FIG. 2 are the brazed portions. Hooks 6 are formed by cutting off portions of these fins 5 in such a manner that the hooks face the sole plate 3 side. As shown in FIG. 2, the hooks 6 on one side are cut at an intermediate part of the fin so as to open only downward and the hooks 6 on the other side at the extreme end parts so as to open both downward and sideward.

Figure 4:
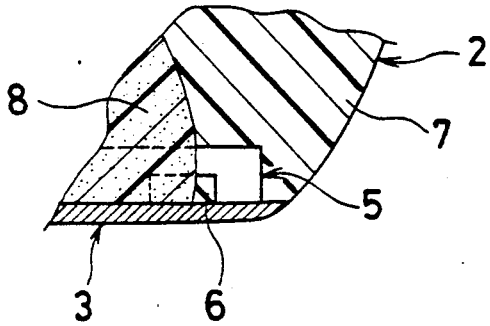
FIG. 4 is a fragmentary longitudinal sectional view of the wood golf club head of the invention.

The sole plate 3 to which the fins 5 are thus fixed is assembled into a molding die together with the club head main body 2 made of an uncured fiber-reinforced resin when the wood golf club head is molded, in such a manner as to bury the fins 5 into the uncured fiber-reinforced resin. When head-treatment is made under this state, the uncured resin flows into the gaps of the hooks 6 of the fins 5 and is cured under such a state. In other words, the fiber-reinforced resin 7 of the club head main body 2 flows into the gaps of the hooks 6 of the fins 5 as shown in FIG. 4 and the fins 5 exhibit a strong anchoring effect to the fiber-reinforced resin.

In the present invention the number of fins 5 to be disposed on the sole plate 3 may be one but is preferably two or more. Moreover, these at least two fins are preferably assembled in a cruciform structure so as to cross one another. The cruciform structure of the two or more fins makes them strong enough to withstand the resin pressure at the time of molding so that the sole plate 3 can be firmly bonded to the golf club head 2.

In the present invention, silver solder, copper solder, brass solder, phosphor bronze, nickel solder and aluminum solder can be used preferably as the brazing material for brazing the fins. Since fixing by brazing does not generate a build-up portion of welding, the gap of the hook 6 formed on the fin 5 is not reduced. Accordingly, a sufficient amount of fiber-reinforced resin flows into the hook 6 which makes an extremely good anchoring effect between the fiber-reinforced resin and the fins 5 so that the bond strength between the club head main body 2 and the sole plate 3 as well as impact resistance at the time of ball hitting is improved.

The sole plate 3 of the driver wood golf club is preferably made of an aluminum alloy having a low specific gravity in the same way as in the prior art. In contrast, nickel silver is used for the sole plate 3 of the fairway wood golf club. Since nickel silver has a high specific gravity, it is effective for lowering the center of mass of the wood golf club head and at the same time, since it has a silver white color, the color of the sole plate of the fairway wood golf club can be made to look the same as that of the sole plate of the driver wood golf club described above. Therefore, when the wood golf clubs of #1 to #6 are used as a set, their sole plates can be unified in color and their commercial value will be thereby improved.

What is claimed is:

1. In a golf club head of the wood-type having a club head main body molded from a fiber-reinforced resin, a sole plate made of a metal fixed to the bottom surface of the club head body and at least one fin having at least one hook portion therein fixed to and extending upwardly from the inner side surface of the sole plate, whereby when said body is molded, the resin thereof will flow into and under the hook portion of the fin to anchor the sole plate to the body, the improvement wherein said fin is fixed to said sole plate by brazing.

2. The golf club head of claim 1, having at least two of said fins that cross one another to form a cruciform structure, each fin having at least one hook portion.

3. The golf club head of claim 1, wherein the material used to fix the fin to the plate is selected from the group consisting of silver solder, copper solder, brass solder, phosphor bronze solder, nickel solder and aluminum solder.

4. The golf club head of claim 1, wherein said sole plate is made of nickel silver.

5. The golf club head of claim 1, wherein the fiber of the fiber-reinforced resin is selected from the group consisting of carbon fiber, glass fiber and aromatic polyamide fiber.

6. The golf club head of claim 1, wherein the resin is a themosetting resin selected from the group consisting of an unsaturated polyester resin, a vinyl ester resin and an epoxy resin.

* * * * *